US008066433B2

(12) United States Patent
Sabounjian

(10) Patent No.: US 8,066,433 B2
(45) Date of Patent: Nov. 29, 2011

(54) VALVE FOR VACUUM STORAGE BAG

(75) Inventor: Azad Sabounjian, Irvine, CA (US)

(73) Assignee: Pro-Mart Industries, Inc., Irvine, CA (US)

( * ) Notice: Subject to any disclaimer, the term of this patent is extended or adjusted under 35 U.S.C. 154(b) by 909 days.

(21) Appl. No.: 12/048,929

(22) Filed: Mar. 14, 2008

(65) Prior Publication Data

US 2009/0232423 A1 Sep. 17, 2009

(51) Int. Cl.
*B65D 33/01* (2006.01)
*F16K 15/14* (2006.01)
*B65B 31/04* (2006.01)

(52) U.S. Cl. ..... 383/103; 137/854; 141/65

(58) Field of Classification Search ..... 383/103; 251/82; 137/512.15, 854, 550; 141/65
See application file for complete search history.

(56) References Cited

U.S. PATENT DOCUMENTS

| | | | |
|---|---|---|---|
| 3,067,119 | A | 12/1962 | Ramaika |
| 3,149,772 | A | 9/1964 | Olsson |
| 3,149,774 | A | 9/1964 | Jepsen |
| 3,186,627 | A | 6/1965 | Evenblij |
| 3,312,221 | A | 4/1967 | Overment |
| 3,473,532 | A | 10/1969 | Eisenberg |
| 3,516,217 | A | 6/1970 | Gildersleeve |
| 3,595,467 | A | 7/1971 | Goglio |
| 3,675,667 | A | 7/1972 | Miller |
| 3,755,991 | A | 9/1973 | Steuernagel |
| 3,833,166 | A | 9/1974 | Murray |
| 3,903,915 | A | 9/1975 | Rosaz |
| 3,937,395 | A | 2/1976 | Lawes |

(Continued)

FOREIGN PATENT DOCUMENTS

EP 08009921 10/1997

(Continued)

OTHER PUBLICATIONS

Four images of a valve for vacuum compression bags believed to be prior art.

*Primary Examiner* — Jes F Pascua
(74) *Attorney, Agent, or Firm* — Stetina Brudna Garred & Brucker; Lowell Anderson

(57) ABSTRACT

A flexible, air-tight storage bag has an entrance opening for inserting an item to be stored into said bag with a releasably-closable seal across said entrance opening. A one-way valve assembly is installed in a surface of the bag and in fluid communication with the inside of the bag to allow air inside the bag to exit the bag. The valve has an outer portion with a conical or curved exterior surface having an apex and a plurality of exit holes adjacent the apex so a vacuum cleaner nozzle can be placed over the exit holes. The outer portion has a conical or curved surface with at least one ridge thereon or groove therein extending away from the apex and beyond the exit holes to reduce the suction. A circular flange in the valve is located so air passes through the flange. A flexible diaphragm is placed in the circular flange so the diaphragm abuts an edge of the flange to vary the flow of air. The diaphragm has a non-symmetric flange formed by outwardly extending tabs so that air pressure on the tabs deforms the diaphragm and breaks the seal between the diaphragm and the flange to allow air flow through the valve.

17 Claims, 4 Drawing Sheets

U.S. PATENT DOCUMENTS 3,949,934 A 4/1976 Goglio et al.
3,960,161 A 6/1976 Norman
3,990,463 A 11/1976 Norman
4,250,994 A 2/1981 Focke
4,404,924 A 9/1983 Goldberg et al.
4,419,855 A 12/1983 Shanklin
4,500,021 A 2/1985 Bildusas
4,532,652 A 7/1985 Herrington
4,576,210 A 3/1986 Lepisto
4,759,641 A 7/1988 Jacobs
4,765,481 A 8/1988 Walsh et al.
4,768,247 A 9/1988 Beier
4,834,554 A 5/1989 Stetler, Jr. et al.
4,905,298 A 2/1990 Walor
4,941,310 A 7/1990 Kristen
4,945,709 A 8/1990 Cert
5,080,155 A 1/1992 Crozier
5,121,840 A 6/1992 Schram
5,137,044 A 8/1992 Brady
5,142,970 A 9/1992 ErkenBrack
5,156,712 A 10/1992 Post
5,203,458 A 4/1993 Cornwell
5,209,264 A 5/1993 Koyanagi
5,318,204 A 6/1994 Davis et al.
5,320,237 A 6/1994 Stolzman
5,333,736 A 8/1994 Kawamura
5,380,898 A 1/1995 Gurtzgen et al.
5,390,898 A 2/1995 Smedley et al.
5,450,963 A 9/1995 Carson
5,480,030 A 1/1996 Sweeney et al.
5,701,996 A 12/1997 Goto et al.
5,735,395 A 4/1998 Lo
5,746,360 A 5/1998 Chen
5,931,189 A * 8/1999 Sweeney et al. ..... 137/512.15
5,937,737 A 8/1999 Karell
6,001,201 A 12/1999 Vincent et al.
6,033,113 A 3/2000 Anderson
6,042,681 A 3/2000 Draghetti
6,059,457 A 5/2000 Sprehe et al.
6,089,271 A 7/2000 Tani et al.
6,103,333 A 8/2000 Keith
6,116,781 A 9/2000 Skeens
D435,354 S 12/2000 Skeens
6,357,915 B2 3/2002 Anderson
6,408,872 B1 * 6/2002 Skeens et al. ..... 137/512.15
6,465,046 B1 10/2002 Hansson et al.
6,491,433 B2 12/2002 Shabram, Jr. et al.
6,494,909 B2 12/2002 Greenhalgh
6,499,574 B1 12/2002 Anthony
6,574,428 B2 6/2003 Nagasaka et al.
6,575,191 B2 * 6/2003 Skeens et al. ..... 137/512.15
6,581,641 B2 6/2003 Skeens et al.
6,588,167 B2 7/2003 Chang
6,604,634 B2 8/2003 Su
6,622,857 B2 9/2003 Ohtsubo et al.
6,634,384 B2 10/2003 Skeens et al.
6,729,473 B2 5/2004 Anderson
6,798,488 B2 9/2004 Murata et al.
6,814,491 B1 11/2004 Tang
6,837,268 B2 * 1/2005 Skeens et al. ..... 137/550
6,893,713 B2 5/2005 Sjoberg et al.
6,953,323 B2 10/2005 Childers et al.
7,004,632 B2 2/2006 Hamilton et al.
7,008,155 B2 3/2006 Smith et al.
7,232,108 B2 * 6/2007 Motonaka et al. ..... 251/100
7,350,541 B2 4/2008 Kobetsky
7,513,481 B2 * 4/2009 Su ..... 251/82
7,565,978 B2 * 7/2009 Han ..... 206/524.8
7,789,563 B2 * 9/2010 Kiyoo ..... 383/103
2002/0090151 A1 7/2002 Skeens et al.
2002/0093517 A1 7/2002 Cheung
2003/0111121 A1 6/2003 Skeens et al.
2005/0152801 A1 7/2005 Chen
2005/0155891 A1 7/2005 Chen
2005/0173439 A1 8/2005 Chen
2005/0190995 A1 * 9/2005 Koyanagi ..... 383/103
2008/0017818 A1 * 1/2008 Tang ..... 251/82
2008/0044113 A1 2/2008 Tilman et al.
2008/0187710 A1 8/2008 Stanchfield et al.
2008/0261000 A1 10/2008 White et al.

FOREIGN PATENT DOCUMENTS

GB 131912 8/1919
GB 714224 8/1954
GB 1269954 4/1972
GB 1497453 1/1978
GB 1511021 5/1978
GB 2031848 4/1980
GB 2418838 7/2004
JP 2006273370 A * 10/2006
WO WO9516619 6/1995
WO WO0112425 A1 2/2001
WO WO03000564 1/2003
WO WO2005091865 3/2005

* cited by examiner

VALVE FOR VACUUM STORAGE BAG

CROSS-REFERENCE TO RELATED APPLICATIONS

Not Applicable

STATEMENT RE: FEDERALLY SPONSORED RESEARCH/DEVELOPMENT

Not Applicable

BACKGROUND

This invention relates to one-way valves used on vacuum storage bags for clothing and other compressible articles. Clothing, pillows, bedding and other compressible articles are often placed in bags which are evacuated to remove the air and compress the articles for compact storage. These bags require a sealable opening to inert articles into and remove articles from the bag, and they require a one-way valve through which air is removed while blocking reentry of air and re-inflation of the bag. Typically a suction device such as the hose form a vacuum cleaner is placed over the valve to suck air from the bag. The suction created from placing the end of a vacuum cleaner nozzle against the pliable bag surface, or against the flat valves fastened to the pliable bag surfaces, is high. The high suction not only makes it hard to reposition the nozzle but it can damage the bag and can suck portions of the garments or articles inside the bag into the valve and damage the garments and articles. Further, the size and suction of vacuum hoses and their nozzles varies enough that some valves do not work well with some nozzles, especially when the valve opening is located within extending walls or flanges covered by caps. There is thus a need for an improved valve which allows a more controlled removal of the air within a vacuum storage bag.

BRIEF SUMMARY

A one-way valve is fastened to a wall of a vacuum storage bag so the valve body has an interior and exterior portion with the wall clamped therebetween. Ribs on the interior portion face the bag contents and help keep articles in the bag from entering a vent opening in the valve. The exterior portion has a curved or inclined shape with at least one and preferably a plurality of ridges and/or grooves. The curved or inclined surface makes it easier to accommodate different sizes of nozzles of a vacuum hose. The ridges and/or grooves allow air to enter the nozzle from outside the bag and makes it easier to position the nozzle on the valve body. The ridges and/or valves still remove air from the bag and through the valve and thus evacuate the bag. The exterior valve configuration can be used with various types of interior one-way valve mechanisms, but preferably a flexible disc is used which flexes away from the bag to allow air to exit when suction is applied to the valve body while sealing off the openings through the valve when the bag is evacuated and the pressure inside the bag is lower than the ambient pressure outside the bag. There is thus provided a valve means for removing air from a vacuum storage providing a diaphragm with areas of varying stiffness extending along at least a portion of the diaphragm contacting with adjacent structure to block the flow of air. These means include a flexible diaphragm placed in a circular flange in the valve so that air passes through the circular flange. The diaphragm abuts an edge of the flange to vary the flow of air. The diaphragm has a non-symmetric flange formed by outwardly extending tabs so that air pressure on the tabs deforms the diaphragm and breaks the seal between the diaphragm and the flange to allow air flow through the valve.

In a preferred embodiment a container comprises a flexible, air-tight bag having an entrance opening for inserting an item to be stored into said bag. A releasably-closable seal is placed across said entrance opening. A one-way valve assembly is installed in a surface of the bag and forms a flow path from the inside of the bag, through a circular flange and to the outside of the bag. The valve has an outer portion with an exterior surface located outside the bag and further has a center with at least one exit hole sufficiently close to the center so a vacuum cleaner nozzle can be placed over the at least one exit hole. The exit hole has a side near the center and a side away from the center. The exterior surface has at least one ridge or at least one groove therein extending away from the center and also has a portion located sufficiently close to the at least one groove or at least one ridge so that the nozzle abuts the ridge or overlaps the groove when the nozzle is placed over the at least one hole during use.

In a further variation the exterior surface is located on an outer body portion which in turn is connected to an inner body portion that contains the circular flange. A flexible diaphragm is resiliently urged against an edge of the circular flange to permit and prevent air flow through that circular flange depending on the configuration of the flexible diaphragm. The diaphragm has at least one tab thereon located to bend in the direction of a suction force applied to the at least one exit hole to change the configuration of the flexible diaphragm and allow air flow through the circular flange from inside the container.

In a further variation of this first embodiment the exterior surface is located on an outer body portion which in turn is connected to an inner body portion that contains the circular flange. A flexible diaphragm is resiliently urged against an edge of the circular flange to permit air flow through the circular flange and into the container and to prevent air flow through that circular flange into the container. The diaphragm has an outwardly extending periphery that is not symmetric and that is also adjacent a symmetrically shaped wall fastened to the inner body portion. The outwardly extending periphery bends when a suction force is applied to the at least one exit hole with the bending changing the configuration of the flexible diaphragm and the contact between the diaphragm and the circular flange to allow air flow through the circular flange.

In further variations of this embodiment, the exterior surface of the outer valve portion can be curved. Alternatively, or in addition, the circular flange may comprise an inner circular flange and may further include an outer circular flange encircling the inner circular flange and concentric therewith. The flexible diaphragm may have a sealing portion sized and configured to sealingly engage the inner circular flange and also having a fastening end fastened to part of the valve located to stretch the diaphragm and resiliently urge the sealing portion against the inner circular flange. The diaphragm may also have at least one tab extending toward the outer circular flange and moving under suction applied to the at least one exit hole to deform the flexible diaphragm and allow air flow through the inner circular flange and out the at least one exit.

Further variations of this embodiment include a diaphragm with a first end fastened to part of the valve to hold that first end in position so the diaphragm can be stretched and resiliently urged against an edge of the circular flange. The diaphragm may have a second end with a conical surface abutting the circular flange and resiliently urged against that circular flange. The second end may have one or more tabs extending therefrom and located so that a suction applied to the at least one exit moves the tabs and deforms the flexible diaphragm to allow air flow through past the diaphragm and out the at lease one exit. In further variations, there are a plurality of tabs on the diaphragm defining a plurality of fold lines as the tabs move in response to suction. Preferably there are four tabs and four fold lines.

In further variations of this embodiment, the diaphragm may have a conical shaped portion with a plurality of tabs at the end of the conical portion and extending away from a longitudinal axis of the conical portion. The exterior surface of the outer valve portion may be curved and there may be four low ridges and four shallow grooves extending radially outward from the center, equally spaced apart. The exterior surface of the outer valve portion may be flat or conical. A filter may be placed over the at least one and each hole in the inner portion to filter air passing through the hole.

In a second embodiment, a storage container is provided having a flexible, air-tight bag having an entrance opening for inserting an item to be stored into said bag. A releasably-closable seal extends across the entrance opening. A one-way valve assembly is installed in a surface of the bag and in fluid communication with the inside of the bag to allow air inside the bag to exit the bag. The valve assembly may include an outer portion having an exterior surface with an outer periphery and a center and a plurality of exit holes extending though the outer portion. The valve assembly may further include an inner portion having a disc with an inner surface and outer surface that has a circular flange extending outward therefrom and having threads on that circular flange which threads are located and configured to threadingly engage the threads on the outer portion. The outer surface of the disc may have an inner circular flange with a plurality of vent holes extending through the disc and located inside the inner circular flange. The inner surface may have a plurality of fins extending outward from a central annular flange to a peripheral edge of the inner portion. The plurality of vent holes are located between the fins adjacent the inner circular flange, with the central flange being located inside the inner circular flange. The second embodiment may further include a flexible diaphragm located inside the inner circular flange of the inner portion and between the inner and outer valve body portions. The diaphragm may have a first sealing position abutting an edge of the central annular flange to block flow through the central annular flange and vent holes and into the container. The diaphragm may have a second position not contacting all of the annular flange to allow air flow through the vent holes and out of the central annular flange and out of the holes in the outer valve portion.

All the variations of the first embodiment may be used with the second embodiment. A further variation advantageously includes a flexible diaphragm with a non symmetric outer periphery such that suction applied to a plurality of the exit holes causes the diaphragm to bend non-uniformly and unblock the central annular flange to allow air to flow through the vent holes and through the central annular flange. The exterior surface of the outer portion is advantageously curved and has at least one ridge or groove therein extending away from the center of the outer portion and toward a periphery of the outer portion. The inner body portion advantageously has a threaded flange which threadingly engages a mating flange on the outer body portion.

A third embodiment of a vacuum storage container is also provided having a flexible, air-tight bag having an entrance opening for inserting an item to be stored into the bag. A releasably-closable seal extends across the entrance opening. A one-way valve is installed in a surface of the bag and in fluid communication with the inside of the bag to allow air inside the bag to exit the bag and to seal when the pressure outside the bag is a greater than the pressure inside the bag. The valve may include an outer body portion connected to an inner body portion with a wall of the bag held between the body portions, with the outer valve body having an exterior surface with air exit holes therein. The inner body portion has a circular flange through which air flows when leaving the bag and valve. Diaphragm means are resiliently urged against the circular flange for allowing air to flow out through the circular flange when suction is applied to the air exit holes and blocking the air flow through the circular flange when the air pressure on the exterior surface of the outer body portion is greater than the air pressure inside the bag.

In further variations of this third embodiment, means are provided for causing the diaphragm means to bend non-uniformly when a suction is applied to the air exit holes. In a still further variation, means are provided on the exterior surface for preventing an air tight seal between a circular tubular nozzle and the exterior surface of the outer body portion when the nozzle is pressed against the outer body portion and encircles a plurality of the air exit holes.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
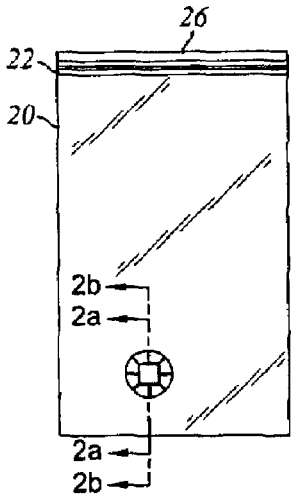
FIG. 1 shows a perspective view of a vacuum storage bag with a one-way valve and a sealable opening.
Figure 2A:
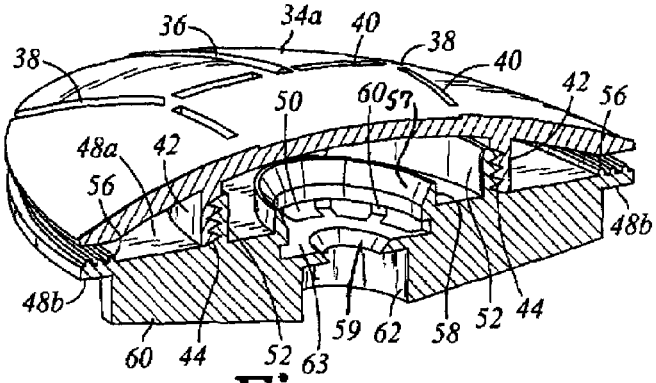
FIG. 2*a* is a perspective view of the a cross sectional view of the valve of FIG. 1 without a flexible diaphragm and taken along section 2*a*-2*a* in FIG. 1.

Referring to FIGS. 1-11, and especially to FIGS. 1-2, a vacuum storage bag 20 has an elongated, releasably closable seal 22 along an entrance 24 to the bag. The entrance 24 usually extends along one end of the bag 20, and the seal is typically a zipper-type seal with one or more elastomeric protrusions fitting inside mating female grooves to form an air tight seal. The bag 10 is made of suitable material, typically polypropylene or other suitable material. A one-way valve 26 allows air to be evacuated from the bag, usually by a suction device such as a vacuum cleaner, but blocks air from entering the bag. Such bags 10 and seals 22 are described in U.S. Pat. Nos. 5,480,030, 5,931,189 and 6,408,872, the complete contents of which are incorporated herein by reference.

The one-way valve 26 has inner and outer portions 28, 30, respectively, enclosing a flexible diaphragm 32 which flexes to control air flow through the valve. As used herein, inner or inward refers to a direction toward the inside of the bag 20 or toward a centerline of the valve 26. Outer or outward refers to a direction away from the inside of the bag or away from a centerline of the valve 26.

Referring to FIGS. 2-5 and 9-11, the outer portion 30 is usually circular in shape with an inclined or curved outer facing, exterior side 34*a*, and an opposing inner facing side 34*b*. One or more ridges 36 and/or grooves 38 are formed in the outer surface 36, and preferably, but optionally extend radially outward toward the periphery of the outer portion 30. One or more exit openings 40 extend through the outer portion 30 to allow air flow through the outer portion 30. The exit openings 40 are shown as sight intermittent slots arranged in a square shape, but other shapes and arrangements can be used.

The inner facing side 34*b* has a short tube or annular flange 42 extending therefrom with threads 44*a* thereon. The threads 44*a* are preferably on the inner side of the annular flange 42. The flange 42 preferably encircles the exit openings 40. The outer portion 30 is preferably thin so the distance between inner and outer faces 34*a*, 34*b* is small, typically less than ⅛ inch. Optionally, a flat annular area 46 forms an inward facing edge that is located around the outer periphery of the outer portion 30.

Referring to FIGS. 2 and 6-8, the inner portion 28 is preferably of the same peripheral shape as outer portion 30, and both are shown here as having a circular periphery. The inner portion 28 has outer and inner facing sides 48*a*, 48*b*, which preferably form a flat shape, and in the depicted embodiment a flat disk. A plurality of holes 50 extend through the side 48 to allow air flow, with the flow being controlled by the flexible diaphragm 32 as described later. The outer facing side 48*a* has an outer facing tube or annular flange 52 having threads 44*b* on it. The flange 52 and threads 44 are sized and configured to threadingly engage with flange 42 and threads 44. Depending on which flange 42, 52 fits inside or outside the other flange, the threads 44, 54 will be external or internal threads—whichever allows the threads to engage. Since threads 44 are shown as located on the inward facing side of flange 42, the threads 54 are located on the outward facing side of flange 52.

Optionally, a plurality of annular ridges 56 are located on the outer face 48*a* and extend around the outer periphery of the inner portion 28. The ridges 56 are located to correspond in location with the annular face 46 on the outer portion 30.

Another short tube or annular flange 58 extends from the outer surface 48*a*. The flange 58 is preferably concentric with and inside of flange 52. Advantageously, the holes 50 are located in spaced relation along the inside of the inner flange 58. A central hole 59 centered in the concentric flanges 52, 58 is preferably provided, so that the side 48 covers the inner flange 58 with the holes 50 formed in the side 48, and preferably formed inside the inner circular flange 58.

Figure 8:
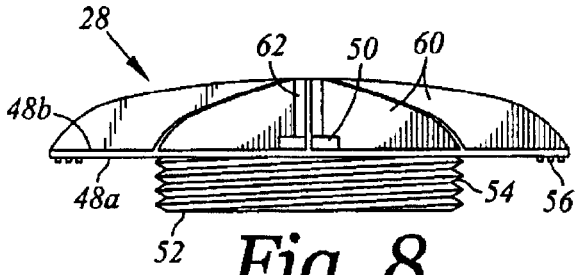
FIG. 8 shows a side view of the inner valve portion of FIG. 6, with the other side view being a mirror image thereof.
Figure 9:
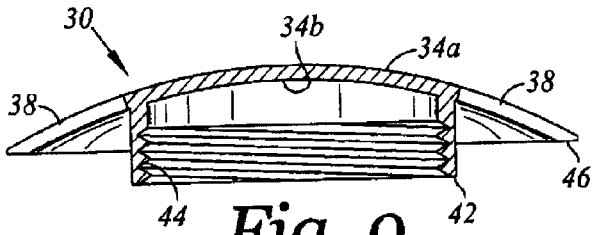
FIG. 9 shows a sectional view taken along section 9-9 of FIG. 3.
Figure 10:
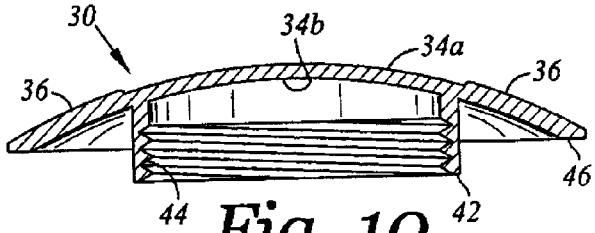
FIG. 10 shows a sectional view taken along section 10-10 of FIG. 3.
Figure 11:
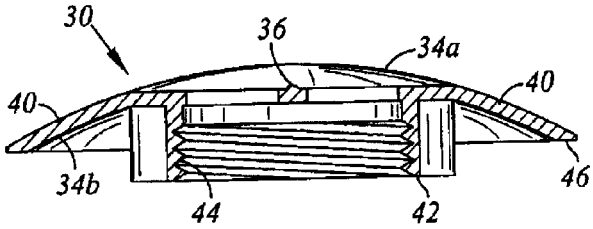
FIG. 11 shows a sectional view taken along section 11-11 of FIG. 3.

The inner facing surface 48*b* has a plurality of ribs, flanges or fins 60 on it. The fins 60 are shown as extending radially outward from a central tube or annular flange 62. The fins 60 advantageously have a generally rectangular cross-sectional shape with a generally uniform height but the height is reduced at the outer periphery where the fins curve downward to the inward facing side 48*b* as best seen in FIG. 8. The end of the fins 60 is shown as curved in FIG. 2*c*, and shown as square in FIG. 2*b*. Other configurations for the ends of the fins 60 could be used, but lower profile fins with smooth surfaces that don't snag cloth, are preferred.

The central annular flange 62 is preferably concentric with and of slightly smaller diameter than annular flange 58, and located on the opposite face of side 48. The holes 50 extend through the side 48 between each fin 60, adjacent the central flange 62. Advantageously, each fin 60 extends between the flange 58 and flange 62, with a notch (FIG. 8) in the fin to reduce the height of the fin between the two flanges 58, 62 and enlarge the holes 50 that extend between adjacent fins 60 between the flanges 58, 62. Thus, referring to FIG. 6, the holes 50 adjacent the flange 58 are separated by the fins 60 and formed in the space between adjacent fins 60, and extend from outer flange 58 to inner flange 62, with flanges 58, 62 being circular and concentric inner flange 62 smaller than outer flange 58 to help form holes 50 between the flanges.

Figure 2B:
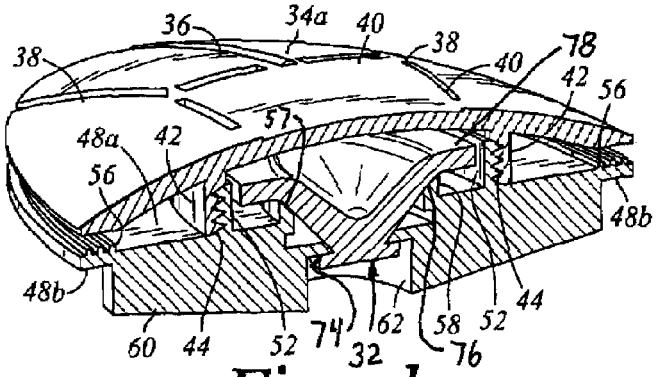
FIG. 2*b* is a perspective view of the a cross sectional view of the valve of FIG. 1 with a flexible diaphragm and taken along section 2*b*-2*b* in FIG. 1.
Figure 2C:
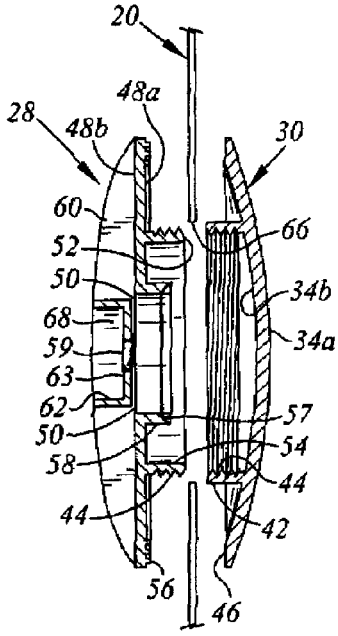
FIG. 2*c* is a cross section of the valve taken along 2*a*-2*a* of FIG. 1, with the parts in an exploded view and without the flexible diaphragm.
Figure 3:
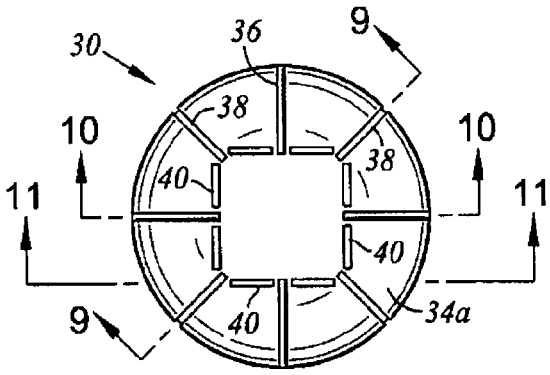
FIG. 3 shows a top plan view of the outer valve portion of the valve of FIG. 1.
Figure 4:
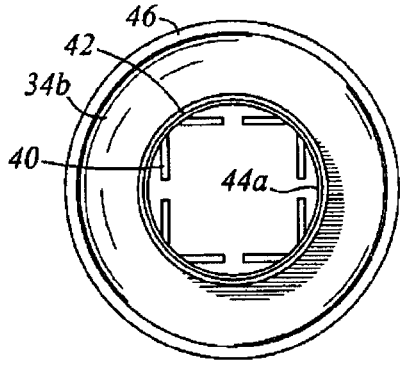
FIG. 4 shows a bottom plan view of the other side of the outer valve portion of FIG. 3.
Figure 5:
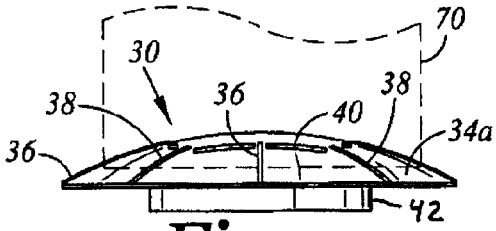
FIG. 5 shows a side view of the outer valve portion of FIG. 3, with the opposing side view being a mirror image thereof.
Figure 6:
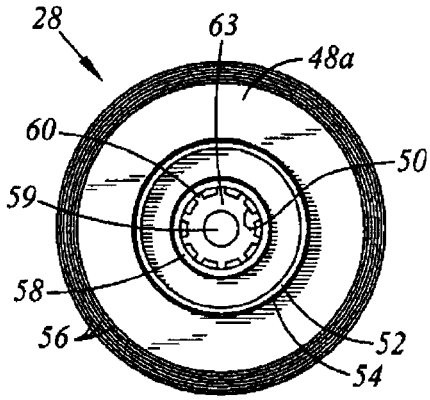
FIG. 6 shows a top plan view of the inner valve portion of the valve of FIG. 1.
Figure 7:
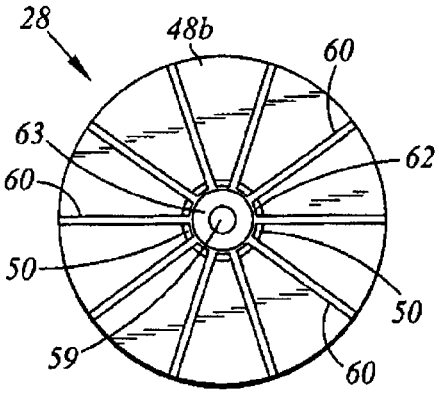
FIG. 7 shows a bottom plan view of the other side of the inner valve portion of the valve of FIG. 6.
Figure 13:
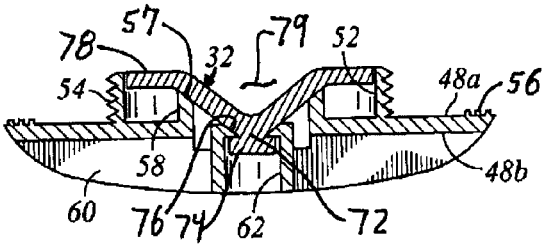
FIG. 13 shows a partial sectional view of the inner valve portion with the diaphragm.
Figure 14:
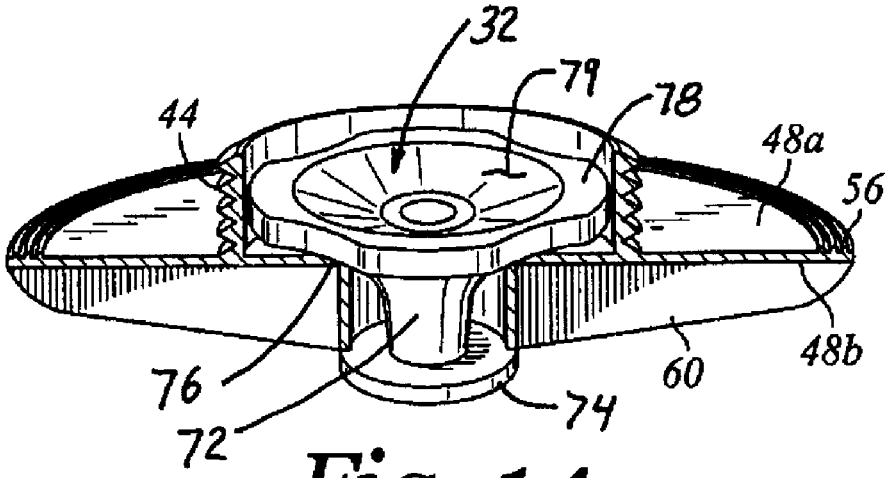
FIG. 14 shows a partial perspective of a portion of the inner valve and diaphragm.

A planar surface 63 covers the outer end of flange 62 and is offset from but parallel to side 48*b*. The hole 59 is formed in the surface 63. The edge of surface 63 forming the hole 59 is inclined, as is the edge of outer flange 58. Referring further to FIGS. 2*b* and 13-14, the flexible diaphragm 32 has a post 72 and locking collar or locking flange 74 with the locking flange 74 extending through tapered hole 59 but being restrained by the tapered hole from passing back through that hole 59. The end of the post 72 opposite the locking flange 74 connects to a sealing portion 76 shaped to align with and seal the edge 57 of flange 58, which edge is preferably inclined. Advantageously, the sealing portion 76 and the abutting edge 57 of flange 58 are complementarily configured so they are inclined the same and form a sealing surface. Advantageously, the edge 57 of the inner circular flange 58 is inclined at an angle of about 45-85 degrees and the abutting surface of sealing portion 76 is similarly shaped and inclined when the parts mate to seal flange 58 against passage of air from the holes 50 that open into the inside of flange 58. Preferably, the edge of surface 63 forming the hole 59 has a similar inclination as the edge 57 of flange 58, so that the locking flange 74 can be pushed easily through the tapered hole 59 to expand on the other side of the hole so that the hole and flange resist passage of the locking flange 74 back through the hole 59.

The edges of the wall 63 defining hole 59 hold the locking flange 74 in position so the diaphragm post 72 can be stretched. Advantageously, the diaphragm 32 is sized so that the distance between the locking flange 74 and sealing portion 76 is about the same as or slightly less than the distance between the surface 63 (which contains hole 59) and the inclined sealing edge 57 so that the sealing portion 76 is resiliently urged against the edge 57 of inner flange 58. Instead of pushing the flange 74 through the hole 59 to lock the flange 74 in position, other fastening mechanisms could be used, including passing a pin or rod through one end of the post 72 to hold it in position, clamping it in position, forming a hole in the end of the post which is hooked or otherwise held in position, or other fastening mechanisms.

The post 72 is preferably tapered, and since flange 58 is circular, the post 72 has a circular cross section, resulting in a post 72 that has a conical shaped body or a general funnel shape with the tip of the funnel extending through the hole 59 and the wide portion of the funnel sealing against the outer edge of flange 58. The outer end of the funnel-shaped diaphragm 32 advantageously has a non-symmetric periphery that may be formed by a plurality of tabs 78 that extend toward but end before outer flange 54. The tabs 78 are generally rectangular in cross section, but the shape can vary. The diaphragm 32 preferably has a hollow portion 79 in its center, which is generally conical shaped or funnel shaped. The diaphragm is made of a flexible material, such as rubber or elastomeric material, but is preferably made of silicon.

As suction is applied to the inside of outer flange 54 the suction will cause the lip of the diaphragm to bend away from the edge 57 of flange 58 to allow air from holes 50 to pass through the valve 26. The greater surface area of tabs 78 will cause the tabs to move more than the area between the tabs, causing the funnel shaped diaphragm 32 to bend at locations defined by the tabs 78. The bend lines are believed to occur between tabs 78 or at the center of tabs 78, depending on the configuration and thickness of the wall of the diaphragm formed between the hollow portion 79 and the sealing portion 76. But the tabs 78 help define predictable bending lines and predictable deformation of the diaphragm 32, thus providing a reliable flow of air past the diaphragm. When the suction is removed, the diaphragm resumes it normal shape with the sealing portion 76 resiliently urged against edge 57 of inner flange 58. A negative pressure in the bag causes the diaphragm 32 to seal against the mating edge of the flange.

Referring to FIGS. 1-2, a circular hole 66 is formed in one sidewall of bag 20. The threads 44, 54 engage to clamp the inner and outer portions 28, 30 to together. As the threads 44, 54 tighten the parts together, the ridges 56 force the wall of bag 20 against outer edge 46 to sealingly grip the wall between those parts (46, 56). If desired, an adhesive can be provided to further seal the parts and prevent air leakage and prevent unscrewing of the portions 28, 30.

The holes 50 allow air to flow from inside the bag 20 through the inner portion 30, holes 50, inner flange 58 and diaphragm 32, while exit holes 40 allow the air to flow through the outer portion 28. The diaphragm 32 flexes to allow outward flow but not inward flow. Ambient air pressure will force the diaphragm 32 against the edge 57 of inner flange 58 block passage of air into the flange 58 and through the holes 50 whenever the ambient air pressure is greater than the pressure inside the bag 20, thus sealing the bag. Advantageously an ambient pressure differential of a few psi will flex the diaphragm 32 to seal the valve, and preferably a pressure differential of 2-3 psi will seal the valve. The use of enlarged tabs 58 helps locate the flex or bend lines of the diaphragm and makes its deformation and performance more predictable. The enlarged tabs 58 also provide a larger surface area which reacts faster to the suction force or other pressure differentials to open the valve under suction. But the tabs 78 are sensitive only to pressure changes from outside the bag 20 and are not affected by the pressure inside the bag 20, since the flange 58 seals against the diaphragm 32 inward of the tabs 58. Thus, the diaphragm 32 opens more readily and more predictably under suction applied to the outer portion 30, but does not open readily based on changes to the pressure inside the bag 20.

The stretch of the diaphragm post 72 between the surface 56 and edge 57 resiliently urges the sealing portion 76 against the inner flange 58 to seal the flange. That stretch affects the ease with which a positive pressure from inside the bag 20 opens the diaphragm 32 to allow air passage. A negative pressure inside the bag 20 will cause the funnel shaped diaphragm 32 to move toward the edge 57 of inner flange 58 and thus further seal against air passage. The diaphragm 32 is configured so that a vacuum inside the bag 20 does not collapse or cause uneven bending of the diaphragm as would unseal the circular flange 58 and allow air to leak out.

Figure 12:
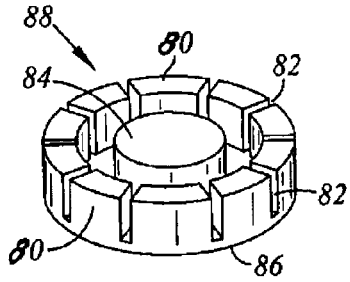
FIG. 12 shows a perspective view of a filter that fits into the center of the inner valve portion of FIG. 7.

The fins 60 face the inside of bag 20 and abut any articles inside the bag to prevent the articles or portions of the articles from blocking air flow out the holes 50, and prevent articles from entering the openings 50 and preventing the diaphragm from sealing the flange 58. Referring to FIG. 12, optionally, a filter material 68 (FIGS. 2, 12) can be placed inside the flange 62 and between the fins 60 adjacent the flange 62 so the filter material 68 covers the holes 50 in order to keep small particles from lodging between sealing portion 78 and edge 57 of inner flange 58 to prevent diaphragm 32 from sealing completely against edge 57. An open cell foam material or a stranded but bound filter material is believed suitable. As seen in FIG. 12, the filter material 68 is preferably shaped as a single piece with segments 80 that fit between fins 60 and separated by slots 82 to fit over the fins 60 and a central plug 84 to fit inside the annular flange 62, and a backing 86 to hold the segments. A hot knife or hot mold can cut the desired shape of filter material 68, or it can be molded to fit. Separate pieces could be used if desired. The filter 68 could be adhered in position, if desired.

Referring to FIGS. 2, 13 and 14, a nozzle 70 (FIG. 5) of a vacuum hose abuts the outer surface **34*a* of the outer portion 30. The nozzles 70 typically have a circular tube with a circular opening in the end and the curved or inclined surface 34*a* allows that circular opening to fit snugly against the surface 34*a* over the exit openings 40 to draw through the valve 26 and out of the bag 20. The ridges 36 and/or grooves 38 prevent the nozzle 70 from sealing against the surface of the outer valve portion 30** so that the nozzle can be positioned more easily on the valve, or so the nozzle can be removed more easily from suction engagement with the valve.

The ridges 36 and/or grooves 38 are preferably small, a few thousands of an inch high and wide for the ridges 36, and a few thousands of an inch wide and deep for grooves 38. Advantageously the ridges are low ridges, meaning they are a few hundredths of an inch high, and preferably under about 0.01 inches high, and of sufficient width for the strength of the valve material so that the ridge is not permanently deformed during use. Advantageously the grooves 38 are shallow grooves, meaning they are a few hundredths of an inch deep, and preferably under about 0.01 inches deep and wide, and not more than ten times wider than they are deep. If only ridges 36 are used, than a symmetrically placed and perfectly centered nozzle 70 will be spaced apart from the outer surface **34*a* by the height of the groove, allowing a potentially large volume of air to enter the nozzle and providing a potentially large reduction in suction. In contrast, if only grooves 38 are used, then a similarly situated nozzle will seal against the outer surface 34*a* except for the cross-sectional area of the grooves 38, providing a smaller volume of air entering the nozzle 70** and providing a smaller reduction in suction.

The ridges and grooves 36, 38 preferably extend radially outward from the apex of the curved or tapered outer surface **34*a*. The ridges and grooves 36, 38 need not cross the apex and preferably begin a distance from the apex of about 0.5 inches and extend toward the outer periphery of outer valve portion 30. Preferably two ridges 36 and two grooves 38 are used, equally spaced about 45 degrees apart. Only ridges 36 could be used. Only grooves 38** could be used.

While the ridges and grooves 36, 38 preferably extend radially outward from the apex of valve portion 30, they could extend other directions. For example, a series of parallel, lateral ridges 36 and/or grooves 38 could be used. The outer surface 34*a* is preferably curved, with a shallow curve being preferred to reduce the height of the outer valve portion 30 and valve 26. But the outer surface 34*a* could be conical.

The exit holes 40 are shown as being centered on the outer surface 34*a*, and are preferably within a diameter sufficient to encompass common nozzle diameters. Advantageously, the exit holes 40 are within a circular diameter of about 1-2 inches, and preferably are within a diameter of about 1.5 inches. The holes 34 are located inside the outer flange 54 on inner portion 28 so that they allow nozzle 70 to apply suction to the diaphragm 32 located inside that outer circular flange 54.

Figure 15:
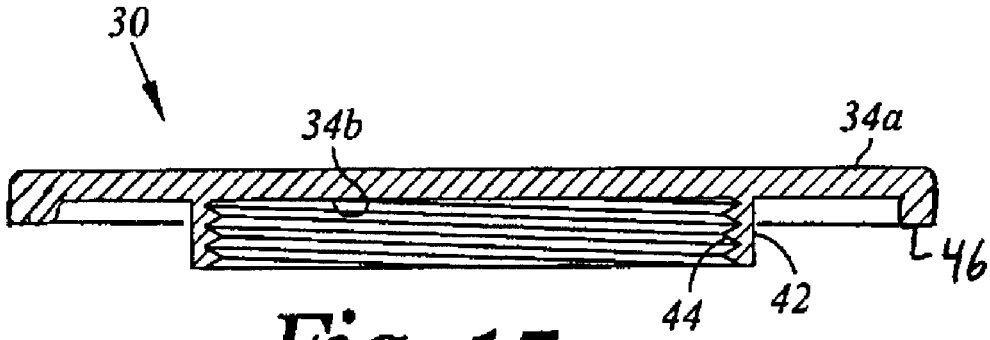
FIG. 15 is a partial perspective view of a flat outer valve portion for use with the valve of FIG. 1.

FIG. 15 shows a further embodiment in which the outer portion 34 is flat instead of slightly domed or curved. A depending flange or hub may optionally be located around the periphery of the outer portion 34 in order to ensure the periphery abuts the ridges 56 in the lower portion and seal against the wall of the bag 20, and to ensure adequate space for the tabs 78 to move toward surface 34*b* so air can pass through the exit holes 40 in the outer body portion 30. All other parts are substantially the same and are the description is not repeated.

The diaphragm 32 and its constituent parts provide means resiliently urged (e.g., by resilient post 72) against the edge 57 of circular flange 58 for allowing air to flow out through the circular flange when suction is applied to the air exit holes 40, and blocking the air flow through the circular flange 58 when the air pressure on the exterior surface of the outer body portion 30 is greater than the air pressure inside the bag or container 20. The non-symmetric periphery of the valve 32, preferably taking the forms of one or more tabs 78, comprise means for causing the diaphragm means to bend non-uniformly when a suction is applied to the air exit holes 40. These means include a flexible diaphragm 32 placed in a circular flange 58 in the valve so that air passes through the circular flange. The diaphragm 32 abuts an edge 57 of the flange 58 to vary the flow of air. The diaphragm 32 has a non-symmetric flange formed by outwardly extending tabs 78 so that air pressure on the tabs deforms the diaphragm and breaks the seal between the diaphragm and the flange edge 57 to allow air flow through the valve. The grooves 36 and/or ridges 38, and other mechanisms described herein as performing the same function, provide means on the exterior surface 34*a* of the outer body portion 30 for preventing an air tight seal between the tubular nozzle 70 and the exterior surface 34*a* of the outer body portion 30 when the nozzle is pressed against the outer body portion and encircles a plurality of the air exit holes 40.

The above description is given by way of example, and not limitation. Given the above disclosure, one skilled in the art could devise variations that are within the scope and spirit of the invention disclosed herein, including various ways of locating the holes and configuring the one-way valve used in connection with the ridges and grooves on the exterior surface 34*a*. Thus, the ridges 36 and grooves 38 can be used with a variety of valves, and are not limited to the particular valve and diaphragm design disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A container, comprising:

a flexible, air-tight bag having an entrance opening for inserting an item to be stored into said bag;

a releasably-closable seal across said entrance opening;

a one-way valve assembly installed in a surface of the bag and forming a flow path from the inside of the bag, through a circular flange and to the outside of the bag, the valve having an outer portion with an exterior surface located outside the bag and further having a center with at least one exit hole sufficiently close to the center so a vacuum cleaner nozzle can be placed over the at least one exit hole, the exit hole having a side near the center and a side away from the center, the exterior surface having at least one ridge or at least one groove therein extending away from the center and having a portion located sufficiently close to the at least one groove or at least one ridge so that the nozzle abuts the ridge or overlaps the groove when the nozzle is placed over the at least one hole during use, wherein the exterior surface is located on an outer body portion which in turn is connected to an inner body portion that contains the circular flange; and a flexible diaphragm resiliently urged against an edge of the circular flange to permit and prevent air flow through that circular flange depending on the configuration of the flexible diaphragm, the diaphragm having at least one tab thereon located to bend in the direction of a suction force applied to the at least one exit hole to change the configuration of the flexible diaphragm and allow air flow through the circular flange from inside the container, the at least one tab being on an outer periphery of the diaphragm which outer periphery is non-circular, the diaphragm having a centrally located post extending therefrom, the post having an end fastened to the valve assembly and not moving relative to the circular flange.

2. The container of claim 1, wherein the flexible diaphragm is resiliently urged against an inclined edge of the circular flange to prevent air flow through the circular flange and into the container and to prevent air flow through that circular flange into the container, the diaphragm periphery being adjacent a symmetrically shaped wall fastened to the inner body portion.

3. The container of claim 1, wherein the exterior surface of the outer valve portion is curved.

4. The container of claim 1, wherein the circular flange comprises an inner circular flange and further comprising an outer circular flange encircling the inner circular flange and concentric therewith; and the flexible diaphragm having a sealing portion sized and configured to sealingly engage the inner circular flange and having a fastening end on the post fastened to part of the valve located to stretch the diaphragm and resiliently urge the sealing portion against the inner circular flange.

5. The container of claim 1, wherein the diaphragm has a first end on the post and is fastened to part of the valve to hold that first end in position so the diaphragm can be stretched, the diaphragm having a second end with a conical surface that abuts the circular flange and is resiliently urged against that circular flange by the stretched diaphragm.

6. The container of claim 5, wherein the diaphragm has a plurality of tabs defining a plurality of fold lines in the diaphragm as the tabs move in response to suction.

7. The container of claim 5, wherein the diaphragm has a conical shaped portion with a plurality of tabs at the end of the conical portion and extending away from a longitudinal axis of the conical portion.

8. The container of claim 1, wherein the exterior surface of the outer valve portion is curved and there are four low ridges and four shallow grooves extending radially outward from the center, equally spaced apart.

9. A container, comprising:

a flexible, air-tight bag having an entrance opening for inserting an item to be stored into said bag;

a releasably-closable seal across said entrance opening;

a one-way valve assembly installed in a surface of the bag and in fluid communication with the inside of the bag to allow air inside the bag to exit the bag, the valve assembly including:

an outer portion having an exterior surface with an outer periphery and a center and a plurality of exit holes extending though the outer portion wherein the exterior surface of the outer portion is curved and has at least one ridge or groove therein extending away from the center of the outer portion and toward a periphery of the outer portion;

an inner portion having a disc with an inner surface and outer surface that has a circular flange extending outward therefrom and having threads on that circular flange which threads are located and configured to threadingly engage the outer portion, the outer surface of the disc having an inner circular flange with a plurality of vent holes extending through the disc and located inside the inner circular flange, the inner surface having a plurality of fins extending outward from a central annular flange to a peripheral edge of the inner portion, the plurality of vent holes being located between the fins adjacent the inner circular flange, the central flange being located inside the inner circular flange;

a flexible diaphragm located inside the inner circular flange of the inner portion and between the inner and outer valve body portions, the diaphragm having a first sealing position abutting an edge of the central annular flange to block flow through the central annular flange and vent holes and into the container, the diaphragm having a second position not contacting all of the annular flange to allow air flow through the vent holes and out of the central annular flange and out of the holes in the outer valve portion, the diaphragm having an outer periphery entirely located outward of the central annular flange, the periphery having at least one tab thereon not connected to any other portion of the periphery of the diaphragm, the tab being large enough to bend in the direction of suction and help the diaphragm to shift between the first and second positions when suction is applied to the exit holes.

10. The container of claim 9, wherein the inner body portion has a threaded flange which threadingly engages a mating flange on the outer body portion.

11. The container as defined in claim 9, wherein the diaphragm has a conical shape with larger and smaller diameter ends, with the larger end abutting the inner circular flange and the smaller end being fastened to the inner portion.

12. The container as defined in claim 11, wherein the diaphragm and central annular flange abut at an inclined angle.

13. The container as defined in claim 9, wherein the outer periphery is immediately adjacent an inner surface of the inner circular flange when no suction is being applied to the exit holes.

14. A vacuum storage container, comprising:

a flexible, air-tight bag having an entrance opening for inserting an item to be stored into the bag;

a releasably-closable seal across the entrance opening;

a one-way valve installed in a surface of the bag and in fluid communication with the inside of the bag to allow air inside the bag to exit the bag and to seal when the pressure outside the bag is a greater than the pressure inside the bag, the valve including:

an outer body portion connected to an inner body portion with a wall of the bag held between the body portions; the outer valve body having an exterior surface with air exit holes therein, the inner body portion having a circular flange through which air flows when leaving the bag and valve;

diaphragm means resiliently urged against the circular flange for allowing air to flow out through the circular flange when suction is applied to the air exit holes and blocking the air flow through the circular flange when the air pressure on the exterior surface of the outer body portion is greater than the air pressure inside the bag, and means for resiliently urging the diaphragm means against the circular flange; and tab means on an outer periphery of the diaphragm means and located outward of the circular flange for responding to suction on the outer body portion to cause the diaphragm means to deform and allow air to pass through the diaphragm means from inside the container, and a post connected to the tab;

means on the exterior surface for preventing an air tight seal between a circular tubular nozzle and the exterior surface of the outer body portion when the nozzle is pressed against the outer body portion and encircles a plurality of the air exit holes.

15. The container of claim 14, further comprising means for causing the diaphragm means to bend non-uniformly when a suction is applied to the air exit holes.

16. A container, comprising:

a flexible, air-tight bag having an entrance opening for inserting an item to be stored into said bag;

a releasably-closable seal across said entrance opening;

a one-way valve assembly installed in a surface of the bag and forming a flow path from the inside of the bag, through a circular flange and to the outside of the bag, the valve having an outer portion with an exterior surface located outside the bag and further having a center with at least one exit hole sufficiently close to the center so a vacuum cleaner nozzle can be placed over the at least one exit hole, the exit hole having a side near the center and a side away from the center, the exterior surface having at least one ridge or at least one groove therein extending away from the center and having a portion located sufficiently close to the at least one groove or at least one ridge so that the nozzle abuts the ridge or overlaps the groove when the nozzle is placed over the at least one hole during use; and wherein the exterior surface of the outer valve portion is curved and there are at least four low ridges and at least four shallow grooves extending radially outward from the center, equally spaced apart.

17. A container, comprising:

a flexible, air-tight bag having an entrance opening for inserting an item to be stored into said bag;

a releasably-closable seal across said entrance opening;

a one-way valve assembly installed in a surface of the bag and forming a flow path from the inside of the bag, through a circular flange and to the outside of the bag, the valve having an outer portion with an exterior surface located outside the bag and further having a center with at least one exit hole sufficiently close to the center so a vacuum cleaner nozzle can be placed over the at least one exit hole, the exit hole having a side near the center and a side away from the center, wherein the exterior surface is located on an outer body portion which in turn is connected to an inner body portion that contains the circular flange; and a flexible diaphragm resiliently urged against an edge of the circular flange to permit and prevent air flow through that circular flange depending on the configuration of the flexible diaphragm, the diaphragm having at least one tab thereon located to bend in the direction of a suction force applied to the at least one exit hole to change the configuration of the flexible diaphragm and allow air flow through the circular flange from inside the container, the at least one tab being on an outer periphery of the diaphragm which outer periphery is non-circular, the diaphragm having a centrally located post extending therefrom, the post having an end fastened to the valve assembly and not moving relative to the circular flange.

* * * * *